US010655326B2

(12) United States Patent
Benefield

(10) Patent No.: US 10,655,326 B2
(45) Date of Patent: May 19, 2020

(54) WOOD BLOCKING BLANK FOR CREATING WOOD BLOCKING FOR METAL STUDS AND METHODS OF MANUFACTURE AND USE THEREOF

(71) Applicant: Cretice Benefield, Auburn, AL (US)

(72) Inventor: Cretice Benefield, Auburn, AL (US)

( * ) Notice: Subject to any disclaimer, the term of this patent is extended or adjusted under 35 U.S.C. 154(b) by 0 days.

(21) Appl. No.: 15/823,629

(22) Filed: Nov. 28, 2017

(65) Prior Publication Data

US 2019/0161962 A1 May 30, 2019

(51) Int. Cl.

| | |
|---|---|
| ***E04B 2/56*** | (2006.01) |
| ***E04B 2/58*** | (2006.01) |
| ***E04B 2/74*** | (2006.01) |

(52) U.S. Cl.

CPC ..... *E04B 2/562* (2013.01); *E04B 2/58* (2013.01); *E04B 2/7457* (2013.01); *E04B 2002/7485* (2013.01); *E04B 2103/04* (2013.01)

(58) Field of Classification Search

USPC ..... 52/591.4

See application file for complete search history.

(56) References Cited

U.S. PATENT DOCUMENTS 274,354 A * 3/1883 Name Not Available ..... E04F 15/10 52/591.4
1,971,010 A * 8/1934 Korn ..... E04F 13/10 52/591.4
2,691,341 A * 10/1954 Williams ..... B41F 17/26 101/35
3,661,688 A * 5/1972 Wheeler ..... B27N 3/06 428/54
4,084,996 A * 4/1978 Wheeler ..... B27D 1/08 156/257
4,586,309 A * 5/1986 Ferguson ..... E04D 1/265 52/540
4,640,857 A * 2/1987 Hasegawa ..... B27D 1/04 428/57
5,059,472 A * 10/1991 Le Bell ..... B32B 21/10 428/161
5,527,103 A * 6/1996 Pittman ..... A01K 63/006 217/12 R
5,906,082 A * 5/1999 Counihan ..... E04F 15/02 52/403.1
6,049,987 A * 4/2000 Robell ..... E04C 2/043 33/1 B (Continued)

*Primary Examiner* — Brian E Glessner
*Assistant Examiner* — Adam G Barlow
(74) *Attorney, Agent, or Firm* — Jeffrey C. Watson; Mathew L. Grell; Grell & Watson Patent Attorneys LLC

(57) ABSTRACT

A wood blocking blank for creating wood blocking for placement between metal studs includes a panel of a blocking material. The panel of blocking material has an original length and a standard width. The standard width is sized to a nominal stud width configured to fit between the metal studs. A groove is cut down the entire original length of the panel of blocking material approximate a first side of the panel of blocking material. The groove is configured for orienting the first side of the panel of blocking material in a soft side of a first metal stud and a second side of the panel of blocking material against the hard side of an adjacent metal stud. The groove is sized to receive the lip of the soft side of the metal stud.

4 Claims, 10 Drawing Sheets

(56) References Cited

U.S. PATENT DOCUMENTS

| | | | | |
|---|---|---|---|---|
| 6,529,799 | B1 * | 3/2003 | Paulk, Jr. | B65C 7/001 700/115 |
| 6,705,056 | B2 * | 3/2004 | Tollenaar | E04B 2/7457 52/317 |
| 7,086,205 | B2 * | 8/2006 | Pervan | E04F 15/02 404/41 |
| 8,005,329 | B2 * | 8/2011 | Shimizu | G06F 3/0421 385/131 |
| 8,268,110 | B2 * | 9/2012 | Pien | E04B 5/026 156/182 |
| 8,828,175 | B2 * | 9/2014 | Roy | B32B 38/10 156/268 |
| 8,950,144 | B2 * | 2/2015 | Padmanabhan | B62D 29/02 52/478 |
| 9,616,650 | B2 * | 4/2017 | Roy | B32B 38/10 |
| 9,988,098 | B2 * | 6/2018 | Padmanabhan | B62D 25/2054 |
| 2002/0110664 | A1 * | 8/2002 | Seidner | B32B 21/08 428/131 |
| 2005/0210827 | A1 * | 9/2005 | Schwartz | E04B 1/7654 52/782.1 |
| 2007/0137779 | A1 * | 6/2007 | Mori | B29C 66/836 156/272.8 |
| 2009/0113838 | A1 * | 5/2009 | Paulsen | B32B 5/022 52/653.1 |
| 2013/0014464 | A1 * | 1/2013 | Risi | B62D 25/2054 52/592.1 |
| 2013/0180198 | A1 * | 7/2013 | Olson | E04F 13/18 52/591.4 |
| 2015/0075901 | A1 * | 3/2015 | Beresowski | E04B 1/86 181/290 |

* cited by examiner

WOOD BLOCKING BLANK FOR CREATING WOOD BLOCKING FOR METAL STUDS AND METHODS OF MANUFACTURE AND USE THEREOF

FIELD OF THE DISCLOSURE

The present disclosure generally relates to blocking, and more specifically, to wood blocking for metal studs and methods of manufacture and use thereof.

BACKGROUND

Generally speaking, blocking is a term for the use of short pieces (blocks) of dimensional lumber in framed construction. Uses may include filling, spacing, joining, or reinforcing members. Blocking may typically be made from short off-cuts or defective, warped pieces of lumber. Blocking is also sometimes used by people in construction with the sense of a shim or spacer. Names for similar materials in other forms of English include dwang, nog, noggin, and nogging. Some blocking is used structurally like cross bracing between joists in a subfloor to prevent buckling and stiffen the floor. This use is also called block bridging, solid bridging, and solid strutting. Fire-blocking is a firestop. Blocks may be spacers between studs such as where an interior wall attaches an exterior wall and for framing corners such as a three-stud corner with blocking. Blocking may also be used for panel edge supports such as sheets of drywall or plywood also called back blocking.

Although the disclosure is not limited thereto, the blocking described herein, may be particularly useful for backing, also referred to as grounds. This type of blocking refers to pieces of wood or other material that run between wall studs in order to provide support and attachment sites for mounted hardware or trim such as cabinets, shelving, handrails, vanity tops without a cabinet underneath, bathroom towel bars, moldings, the like, etc. Properly installed blocking is easier to find for attaching wall hardware than studs alone. Once drywall, or any other material, covers the wall it can be difficult to find 2×4 studs for attachment, and the position of nails and screws must be adjusted to stud location. Thus, if blocking is installed at a uniform and predetermined height, attachment sites can be found without using a stud finder, and the blocking can be utilized anywhere along a wall at that height. This is particularly useful for installing upper cabinets in kitchens or bathrooms as they tend to be heavy and finding appropriate studs for installation can be difficult.

Currently, the practice of installing wood blocking for backing in metal studs, like in commercial construction, is a time-consuming process that requires the installers to make their own blocking. This is obviously very labor intensive and requires not only skilled labor, but also special tools, including power equipment, thereby requiring electricity to be run to the installation location. As such, there is clearly a need to provide wood blocking, and a method of manufacturing and installing thereof, that is quicker and easier to install.

In addition, because blocking may typically be created from scrap wood, or short off-cuts or defective, warped pieces of lumber, the quality and reliability of the backing may be inconsistent and/or weak. This may be especially problematic for providing backing for high weight applications, like handicap railing, and/or for providing backing for applications requiring specific rating, like fire rated materials. As such, there is clearly a need for a better quality and more reliable wood blocking material.

The instant disclosure of a wood blocking blank for creating wood blocking for metal studs and methods of manufacture and use thereof may be designed to address at least certain aspects of the problems discussed above.

SUMMARY

Briefly described, in a possibly preferred embodiment, the present disclosure overcomes the above-mentioned disadvantages and meets the recognized need for such an apparatus or method by providing of a wood blocking blank for creating wood blocking for placement between metal studs. The wood blocking blank includes a panel of blocking material, like plywood, composites, or the like. The panel of blocking material may have an original length and a standard width. The standard width is sized to a nominal stud width configured to fit between the metal studs. A groove is cut down the entire original length of the panel of blocking material approximate a first side of the panel of blocking material. The groove is configured for orienting the first side of the panel of blocking material in a soft side of a first metal stud and a second side of the panel of blocking material against the hard side of an adjacent metal stud. The groove is sized to receive the lip of the soft side of the metal stud.

In select embodiments, the groove cut in the wood blocking blank may be a through dado running the entire original length of the panel of blocking material. The through dado may run across grain, or with the grain, from a top edge to a bottom edge. As an example, and clearly not limited thereto, the through dado may be approximately 0.3 inches deep by 0.75 inches wide along the entire original length of the panel of blocking material. In select embodiments, the center of the groove may be cut a distance from the first side of the panel that is approximately a width of the stud flange (like 1.25", 1.375", 1.625", 2.0", 2.5", 3.0", etc.). However, the width of the groove may be cut wide enough to receive the lip from multiple size widths of stud flanges.

One feature of the wood blocking blank disclosed herein may be that it can include a continuous stamp along the entire original length of the panel of blocking material. The continuous stamp may include repeated information of the blocking material that is configured to be visible on each piece of blocking created from the panel of blocking material. In select embodiments, the repeated information of the continuous stamp along the entire length of the blocking material may include, but is not limited to, a manufacturer, a rating of blocking material, and a location. The continuous stamp may be configured so that each piece of blocking created from the panel of blocking material may include at least the manufacturer, a rating of blocking material, and a location. In select embodiments, the continuous stamp may be positioned approximate the groove in the panel of blocking material in a horizontal orientation. Whereby, the continuous stamp may be configured to be visible when installed between the metal studs for inspection.

Another feature of the wood blocking blank disclosed herein may be that the length of the panel of blocking material may be configured to be cut to a desired height of blocking or left at the original length. In select embodiments, but not limited thereto, the length of the panel of blocking material may be configured to be cut in ninths, eighths, sevenths, sixths, fifths, fourths, thirds, halves, combinations thereof, or left at the original length. As examples, and clearly not limited thereto, when the original length is 48 inches, the cut lengths may be: approximately 5 and ⅛ inches when cut in ninths; approximately 5 and ⅞ inches when cut in eighths; approximately 6 and ¾ inches when cut in sevenths; approximately 7 and ⅞ inches when cut in sixths; approximately 9 and ½ inches when cut in fifths; approximately 11 and ¾ inches when cut in fourths; approximately 15 and ¾ inches when cut in thirds; approximately 23 and ⅞ inches when cut in halves; and approximately 48 inches when left at original length. As such, when the original length is 48 inches and the standard width is 15.75 inches, which is sized to the nominal stud width between the metal studs of 16 inches, the example blockings created may be, but are not limited to: a number five blocking of approximately 5 and ⅛ inches by 15.75 inches when cut in ninths; a number six blocking of approximately 5 and ⅞ inches by 15.75 inches when cut in eighths; a number seven blocking of approximately 6 and ¾ inches by 15.75 inches when cut in sevenths; a number eight blocking of approximately 7 and ⅞ inches by 15.75 inches when cut in sixths; a number ten blocking of approximately 9 and ½ inches by 15.75 inches when cut in fifths; a number twelve blocking of approximately 11 and ¾ inches by 15.75 inches when cut in fourths; a number sixteen blocking of approximately 15 and ¾ inches by 15.75 inches when cut in thirds; a number twenty-four blocking of approximately 23 and ⅞ inches by 15.75 inches when cut in halves; and a number forty-eight blocking of approximately 48 inches by 15.75 inches when left at original length. Other examples include, but are not limited thereto, when the original length is 48 inches and the standard width is 11.75 inches, 13.25 inches, 15.75 inches, 19.05 inches, or 23.75 inches being sized to the nominal stud width between the metal studs of 12 inches, 13.5 inches, 16 inches, 19.2 inches or 24 inches, respectively, the blockings created may be: approximately 5 and ⅛ inches by 11.75 inches, 13.25 inches, 15.75 inches, 19.05 inches, or 23.75 inches, when cut in ninths; approximately 5 and ⅞ inches by 11.75 inches, 13.25 inches, 15.75 inches, 19.05 inches, or 23.75 inches, when cut in eighths; approximately 6 and ¾ inches by 11.75 inches, 13.25 inches, 15.75 inches, 19.05 inches, or 23.75 inches, when cut in sevenths; approximately 7 and ⅞ inches by 11.75 inches, 13.25 inches, 15.75 inches, 19.05 inches, or 23.75 inches, when cut in sixths; approximately 9 and ½ inches by 11.75 inches, 13.25 inches, 15.75 inches, 19.05 inches, or 23.75 inches, when cut in fifths; approximately 11 and ¾ inches by 11.75 inches, 13.25 inches, 15.75 inches, 19.05 inches, or 23.75 inches, when cut in fourths; approximately 15 and ¾ inches by 11.75 inches, 13.25 inches, 15.75 inches, 19.05 inches, or 23.75 inches, when cut in thirds; approximately 23 and ⅞ inches by 11.75 inches, 13.25 inches, 15.75 inches, 19.05 inches, or 23.75 inches, when cut in halves; and approximately 48 inches by 11.75 inches, 13.25 inches, 15.75 inches, 19.05 inches, or 23.75 inches, when left at original length.

Another feature of the wood blocking blank disclosed herein may be that the blank and/or blocking created therefrom may be combined to create longer lengths. As an example, and clearly not limited thereto, a 48 inch blank and a 24 inch blocking may be combined for a total length of 72 inches, like for a toilet partition. As another example, an 8 inch blocking may be combined with a 5 inch blocking for a total length of 13 inches. A z-clip may be included between panel to panel connections for easier assembly.

In another aspect, the instant disclosure embraces a pallet of wood blocking. The pallet of wood blocking may generally include a first row of wood blocking bundles, a second row of wood blocking bundles, and a base pallet. The first row of wood blocking bundles on the pallet may have a first row width and a first row length. The second row of wood blocking bundles on the pallet may have a second row width and a second row length. As such, the base pallet may have a pallet width of approximately the first row width plus the second row width. The base pallet may also have a pallet length of approximately the first row length and/or the second row length. Whereby, the base pallet may be configured for supporting the first and second rows of wood blocking bundles side by side.

One feature of the pallet of wood blocking described herein may be that the pallet width may be small enough to allow the pallet of wood blocking to be pulled through a door. As an example, when the first row of wood blocking may have a first row width of approximately 15.75 inches and the second row of wood blocking may have a second row width of approximately 15.75 inches, the pallet width may be approximately 32 inches or less. As such, the pallet width of approximately 32 inches or less may be small enough to allow the pallet of wood blocking to be pulled through a standard 3/0 door (approximately 34.5 inches).

In select embodiments of the pallet of wood blocking disclosed herein, the first row of wood blocking may have the first row length being equal to an original length of a panel of blocking material and the first row width of a standard width of the panel of blocking material, and the second row of wood blocking may have the second row length being equal to the original length of the panel of blocking material and the second row width of the standard width of the panel of blocking material. Wherein, the base pallet may have a pallet width of twice the standard width of the panel of blocking material, and a pallet length of said original length of the panel of blocking material. Whereby, the base pallet may be configured for supporting the first and second rows of wood blocking bundles side by side.

In select embodiments of the pallet of wood blocking disclosed herein, the first row of wood blocking and the second row of wood blocking may include, but are not limited to: a single blank of the original length of the panel of blocking material; two bundles of the original length of the panel of blocking material cut in halves; three bundles of the original length of the panel of blocking material cut in thirds; four bundles of the original length of the panel of blocking material cut in fourths; five bundles of the original length of the panel of blocking material cut in fifths; six bundles of the original length of the panel of blocking material cut in sixths; seven bundles of the original length of the panel of blocking material cut in sevenths; eight bundles of the original length of the panel of blocking material cut in eighths; nine bundles of the original length of the panel of blocking material cut in ninths; or combinations thereof that equal the original length of the panel of blocking material. In select embodiments, the various bundles may include color coding for distinguishing or recognizing the size difference of each bundle. A weight of each bundle may be equal to a nominal weight of the panel of blocking material. As a result, a total weight of the first row of wood blocking and a total weight of the second row of wood blocking may be approximately equal to a row of the panel of blocking material. In addition, an area or square footage of each bundle may be equal to a nominal area or square footage of the panel of blocking material. As a result, a total volume or cubic footage of the first row of wood blocking and a total volume or cubic footage of the second row of wood blocking may be approximately equal to a row of the panel of blocking material.

In another aspect of the instant disclosure, a method of installing wood blocking between metal studs is disclosed herein. The method of installing wood blocking may generally include the step of creating the wood blocking blank for creating wood blocking for placement between metal studs, in any of the embodiments shown and/or described herein. As a result, the method may include the steps of cutting a groove down the entire original length of the panel of blocking material approximate a first side of the panel of blocking material. The groove may be configured for orienting the first side of the panel of blocking material in a soft side of a first metal stud and a second side of the panel of blocking material against the hard side of an adjacent metal stud, where the groove may be sized to receive the lip of the soft side of the metal stud. In addition, the method of installing wood blocking between metal studs may include the step of cutting the length of the panel of blocking material to a desired height of wood blocking or leaving the length of the panel of blocking material at the original length for the height of the wood blocking.

In select embodiments of the method of installing wood blocking, the step of cutting a groove down the entire original length of the panel of blocking material may include cutting a through dado running the entire original length of the panel of blocking material across grain from a top edge to a bottom edge, wherein the through dado may be, but is not limited to, approximately 0.3 inches deep by 0.75 inches wide along the entire original length of the panel of blocking material. In select embodiments, the groove may be cut approximately 1.5 inches at its center from the first side of the panel of blocking material.

In select embodiments of the method of installing wood blocking, the method may further include the step of applying a continuous stamp along the entire original length of the panel of blocking material. The continuous stamp may be applied including repeated information of the blocking material that is configured to be visible on each piece of blocking created from the panel of blocking material. The repeated information of the continuous stamp along the entire length of the blocking material may include, but is not limited to, a manufacturer, a rating of blocking material, and a location, wherein each piece of blocking created from the panel of blocking material includes at least the manufacturer, the rating of blocking material, and the location. The continuous stamp may be positioned approximate the groove in the panel of blocking material in a horizontal orientation, whereby the continuous stamp may be configured to be visible when installed between the metal studs.

In select embodiments of the method of installing wood blocking disclosed herein, the step of cutting the length of the panel of blocking material to a desired height of wood blocking or leaving the length of the panel of blocking material at the original length for the height of the wood blocking may include cutting the original length in ninths, eighths, sevenths, sixths, fifths, fourths, thirds, halves, combinations thereof, or left at the original length.

In select embodiments of the method of installing wood blocking disclosed herein, the method may further include the step of bundling the wood blocking into bundles of the wood blocking.

In select embodiments of the method of installing wood blocking disclosed herein, the method may further include the step of creating a pallet of the wood blocking from the bundles for transportation;

In select embodiments of the method of installing wood blocking disclosed herein, the method may further include the step of putting the wood blocking, the bundles, the pallet of wood blocking, or combinations thereof into a commercial estimate for calculating labor and material.

In select embodiments of the method of installing wood blocking disclosed herein, the method may further include the step of mounting the wood blocking between metal studs This step of mounting the wood blocking between metal studs may include, but is not limited to, the steps of: orienting the groove on the first side of the blocking in a soft side of a first metal stud, where a lip of the soft side of the metal stud is positioned in the groove; orienting a second side of the blocking against the hard side of an adjacent metal stud; and securing the wood blocking between the metal studs. In select embodiments, the step of securing the wood blocking between the metal studs may include: clamping the first side of the wood blocking to the soft side of the first metal stud; clamping the second side of the wood blocking to the hard side of the adjacent metal stud; attaching the first side of the wood blocking to the soft side of the first metal stud with fasteners; and attaching the second side of the wood blocking to the hard side of the adjacent metal stud with fasteners and a z-clip.

The foregoing illustrative summary, as well as other exemplary objectives and/or advantages of the disclosure, and the manner in which the same are accomplished, may become more apparent to one skilled in the art from the prior Summary, and the following Brief Description of the Drawings, Detailed Description, and Claims when read in light of the accompanying Detailed Drawings.

BRIEF DESCRIPTION OF THE DRAWINGS

The present apparatuses, systems and methods will be better understood by reading the Detailed Description with reference to the accompanying drawings, which are not necessarily drawn to scale, and in which like reference numerals denote similar structure and refer to like elements throughout, and in which.

Figures 1, 1A:
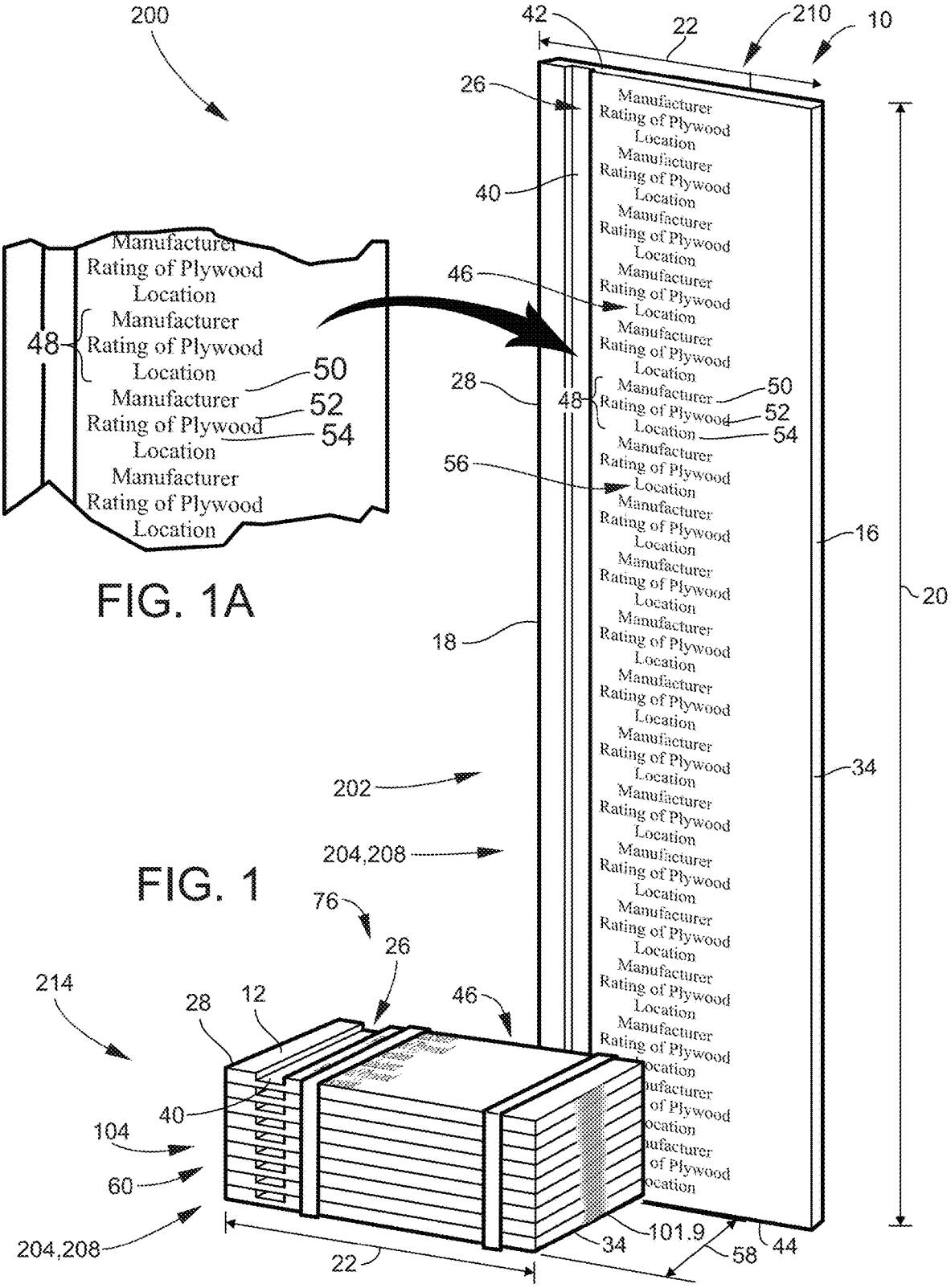
FIG. 1 schematically depicts a top perspective view of a wood blocking blank for creating wood blocking for placement between metal studs according to select embodiments with a bundle of wood blocking created from the wood blocking blank by cutting it into ninths.
FIG. 1A schematically depicts a zoomed in view of the wood blocking blank from FIG. 1 showing the repeated information according to select embodiments of the instant disclosure.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-11, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1-10, in a possibly preferred embodiment, the present disclosure overcomes the above-mentioned disadvantages and meets the recognized need for such an apparatus or method by providing of wood blocking blank 10 for creating wood blocking 12 for placement between metal studs 14 (see FIGS. 4-10). The wood blocking blank 10 includes panel 16 of blocking material 18. Panel 16 of blocking material 18 may be any desired type of blocking material, including any plywood, composites or the like. In select possibly preferred embodiments, the blocking material 18 may include fire-retardant-treated plywood. This fire-retardant-treated plywood may include plywood impregnated with chemicals to meet building code. As an example, panel 16 of blocking material 18 may be plywood with Pyro-Guard® provided by Hoover Treated Wood Products, Inc. of McDuffie County, Ga. The panel 16 of blocking material 18 may have any desired size, including any desired length and/or width. In select embodiments, the panel 16 of blocking material 18 may have original length 20 and standard width 22. The standard width 22 may be sized to nominal stud width 24 (see FIGS. 4-10) configured to fit between the metal studs 14.

Groove 26 may be included in panel 16 of blocking material 18. Groove 26 may be cut down the entire original length 20 of the panel 16 of blocking material 18 approximate first side 28 of the panel 16 of blocking material 18. Groove 26 may be cut into wood blocking blank 10 to make sure that each wood blocking 12 cut or made from wood blocking blank 10 includes groove 26 so that each wood blocking 12 can be oriented and mounted between metal studs 14. By cutting groove 26 into blank 10, prior to making each wood blocking 12, not only are a lot of time and resources saved (1 cut versus multiple cuts), but also the groove can be more consistent from one wood blocking 12 to the next. The groove 26 may be configured for orienting the first side 28 of the panel 16 of blocking material 18, or blocking 12 created therefrom, in soft side 30 of a first metal stud 32 and a second side 34 of the panel 16 of blocking material 18, or blocking 12 created therefrom, against the hard side 36 of an adjacent metal stud 35 (see FIGS. 4-10). The groove 26 may be sized to receive lip 38 of soft side 30 of the first metal stud 32. In select embodiments, the groove 26 may be cut in the wood blocking blank 10 may be a through dado 40 running the entire original length 20 of the panel 16 of blocking material 18. The through dado 40 may run across grain from top edge 42 to bottom edge 44. As an example, and clearly not limited thereto, the through dado 40 may be approximately 0.3 inches deep by 0.75 inches wide along the entire original length 20 of the panel 16 of blocking material 18. In select embodiments, the groove 26 may be cut approximately 1.5 inches at its center from the first side 28 of the panel 16 of blocking material 18.

Continuous stamp 46 may be included as one feature of the wood blocking blank 10 disclosed herein. Continuous stamp 46 may be applied or printed on wood blocking blank 10 to make sure that each wood blocking 12 cut or made from wood blocking blank 10 includes the origination information of each wood blocking 12 made therefrom, like the desired information of what, where, how, ingredients, rating etc. wood blocking 12 was made. Continuous stamp 46 may be included at any position on panel 16 of blocking material 18. Continuous stamp 46 may be positioned along the entire original length 20 of the panel 16 of blocking material 18. The continuous stamp 46 may include repeated information 48 of the blocking material 18 that is configured to be visible on each piece of blocking 12 created from the panel 16 of blocking material 18. In select embodiments, the repeated information 48 of the continuous stamp 46 along the entire original length 20 of the blocking material 18 may include, but is not limited to, manufacturer 50, rating of blocking material 52 (i.e. treated, fire retardant, etc.), and location 54 (i.e. where the blocking material 18 was manufactured). The continuous stamp 46 may be configured so that each piece of blocking 12 created from the panel 16 of blocking material 18 may include at least manufacturer 50, rating of blocking material 52, and location 54. In select embodiments, the continuous stamp 46 may be positioned approximate the groove 26 of the panel 16 of blocking material 18 in horizontal orientation 56. Whereby, the continuous stamp 46 may be configured to be visible when installed between the metal studs 14 for inspection. By placing the continuous stamp 46 approximate the groove 26, the blocking 12 may be cut at the second side 34 for various widths of metal studs 14, where the continuous stamp 46 may still be visible even when the blocking 12 is cut.

The wood blocking blank 10 disclosed herein may be that the original length 20 of the panel 16 of blocking material 18 may be configured to be cut to a desired height 58 of blocking 12 or left at the original length 20. In select embodiments, the original length 20 of the panel 16 of blocking material 18 may be configured to be cut in ninths 60, eighths 62, sevenths 64, sixths 66, fifths 68, fourths 70, thirds 72, halves 74, combinations thereof, or left at the original length 20. See FIGS. 1-2. As examples, and clearly not limited thereto, when the original length 20 is 48 inches, the cut lengths may be: approximately 5 and ⅛ inches when cut in ninths 60; approximately 5 and ⅞ inches when cut in eighths 62; approximately 6 and ¾ inches when cut in sevenths 64; approximately 7 and ⅞ inches when cut in sixths 66; approximately 9 and ½ inches when cut in fifths 68; approximately 11 and ¾ inches when cut in fourths 70;

approximately 15 and ¾ inches when cut in thirds 72; approximately 23 and ⅞ inches when cut in halves 74; and approximately 48 inches when left at original length 20. As such, when the original length is 48 inches and the standard width 22 is 15.75 inches, which is sized to the nominal stud width 24 between the metal studs 14 of 16 inches, the example blockings created may be, but are not limited to: a number five blocking 76 of approximately 5 and ⅛ inches by 15.75 inches when cut in ninths 60; a number six blocking 78 of approximately 5 and ⅞ inches by 15.75 inches when cut in eighths 62; a number seven blocking 80 of approximately 6 and ¾ inches by 15.75 inches when cut in sevenths 64; a number eight blocking 82 of approximately 7 and ⅞ inches by 15.75 inches when cut in sixths 66; a number ten blocking 84 of approximately 9 and ½ inches by 15.75 inches when cut in fifths 68; a number twelve blocking 86 of approximately 11 and ¾ inches by 15.75 inches when cut in fourths 70; a number sixteen blocking 88 of approximately 15 and ¾ inches by 15.75 inches when cut in thirds 72; a number twenty-four blocking 90 of approximately 23 and ⅞ inches by 15.75 inches when cut in halves 75; and a number forty-eight blocking 92 of approximately 48 inches by 15.75 inches when left at original length 20. Other examples include, but are not limited thereto, when the original length 20 is 48 inches and the standard width 22 is 11.75 inches, 13.25 inches, 15.75 inches, 19.05 inches, or 23.75 inches being sized to the nominal stud width 24 between the metal studs of 12 inches, 13.5 inches, 16 inches, 19.2 inches or 24 inches, respectively, the blockings created may be: approximately 5 and ⅛ inches by 11.75 inches, 13.25 inches, 15.75 inches, 19.05 inches, or 23.75 inches, when cut in ninths 60; approximately 5 and ⅞ inches by 11.75 inches, 13.25 inches, 15.75 inches, 19.05 inches, or 23.75 inches, when cut in eighths 62; approximately 6 and ¾ inches by 11.75 inches, 13.25 inches, 15.75 inches, 19.05 inches, or 23.75 inches, when cut in sevenths 64; approximately 7 and ⅞ inches by 11.75 inches, 13.25 inches, 15.75 inches, 19.05 inches, or 23.75 inches, when cut in sixths 66; approximately 9 and ½ inches by 11.75 inches, 13.25 inches, 15.75 inches, 19.05 inches, or 23.75 inches, when cut in fifths 68; approximately 11 and ¾ inches by 11.75 inches, 13.25 inches, 15.75 inches, 19.05 inches, or 23.75 inches, when cut in fourths 70; approximately 15 and ¾ inches by 11.75 inches, 13.25 inches, 15.75 inches, 19.05 inches, or 23.75 inches, when cut in thirds 72; approximately 23 and ⅞ inches by 11.75 inches, 13.25 inches, 15.75 inches, 19.05 inches, or 23.75 inches, when cut in halves 74; and approximately 48 inches by 11.75 inches, 13.25 inches, 15.75 inches, 19.05 inches, or 23.75 inches, when left at original length 20. Although the disclosure is directed toward even cuts down the original length 20 of panel 16 of blocking material 18, the disclosure is not so limited, and various lengths, or combination of lengths, may be cut from wood blocking blank 10, like one blocking 12 of ½ the original length 20, and 2 blockings 12 of ¼ of the original length 20, and so forth.

Another feature of the wood blocking blank 10 disclosed herein may be that the blank 10 and/or blocking 12 created therefrom may be combined to create longer lengths. As an example, and clearly not limited thereto, a 48 inch blank 10 and a 24 inch blocking 12 may be combined for a total length of 72 inches, like for a toilet partition. As another example, an 8 inch blocking 12 may be combined with a 5 inch blocking 12 for a total length of 13 inches. Z-clips 93 may be included between panel to panel connections for easier assembly.

Figure 2:
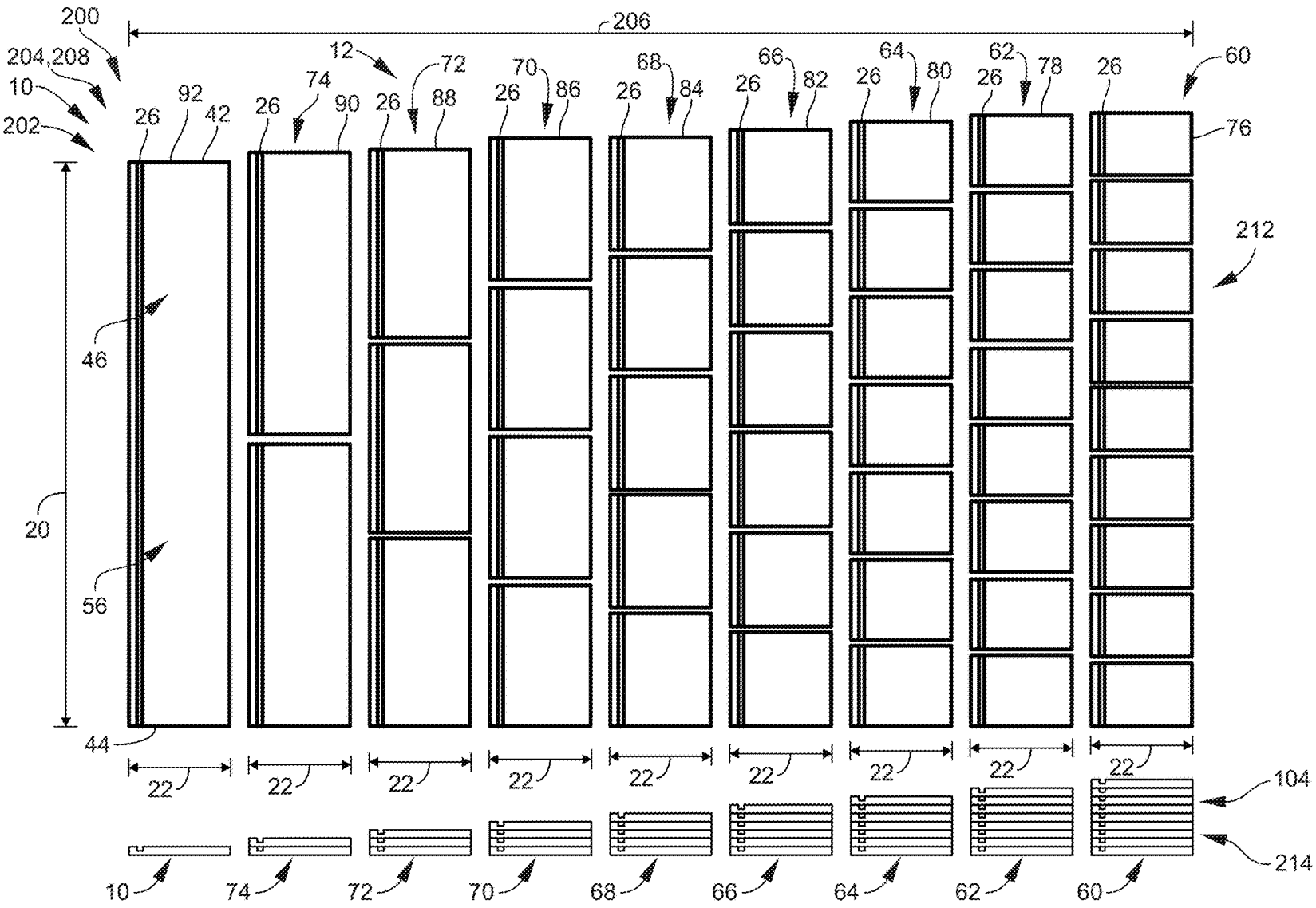
FIG. 2 schematically depicts a front view of various embodiments of wood blocking blank from FIG. 1 being left at the original length, cut in halves, thirds, fourths, fifths, sixths, sevenths, eighths, and ninths, and a bottom view of each respective bundle depicted below.

Referring to FIGS. 1-2, bundles 104 may be created from wood blocking 12 cut from wood blocking blank 10. Each bundle 104 may include the number of wood blocking 12 cut from wood blocking blank 10. As such, as shown in FIGS. 1-2, each bundle may include: a single wood blocking 12 when panel 16 of blocking material 18 is left at its original length 20; two wood blockings 12 when panel 16 of blocking material 18 is cut in halves 74 with a length of original length 20 divided by 2; three wood blockings 12 when panel 16 of blocking material 18 is cut in thirds 72 with a length of original length 20 divided by 3; four wood blockings 12 when panel 16 of blocking material 18 is cut in fourths 70 with a length of original length 20 divided by 4; five wood blockings 12 when panel 16 of blocking material 18 is cut in fifths 68 with a length of original length 20 divided by 5; six wood blockings 12 when panel 16 of blocking material 18 is cut in sixths 66 with a length of original length 20 divided by 6; seven wood blockings 12 when panel 16 of blocking material 18 is cut in sevenths 64 with a length of original length 20 divided by 7; eight wood blockings 12 when panel 16 of blocking material 18 is cut in eighths 62 with a length of original length 20 divided by 8; and nine wood blockings 12 when panel 16 of blocking material 18 is cut in ninths 60 with a length of original length 20 divided by 9. As a result, the total weight of each bundle 104 will be approximately equal to the weight of the blank 10. In addition, the total square footage that each bundle will cover will be approximately equal to the square footage of the blank 10. As such, each bundle 104 purchased or required may be easily used for a commercial estimate for calculating labor and material. However, the disclosure is not limited to just be cut into ninths or less, as 10ths, $11^{th}$, 12ths, 13ths, etc. may be desired. For example, if blank 10 is 96 inches, of if there is a 10 foot sheet of blocking material 14 by five feet wide, the blank 10 may clearly be cut in more pieces of blocking 12.

Figure 3A:
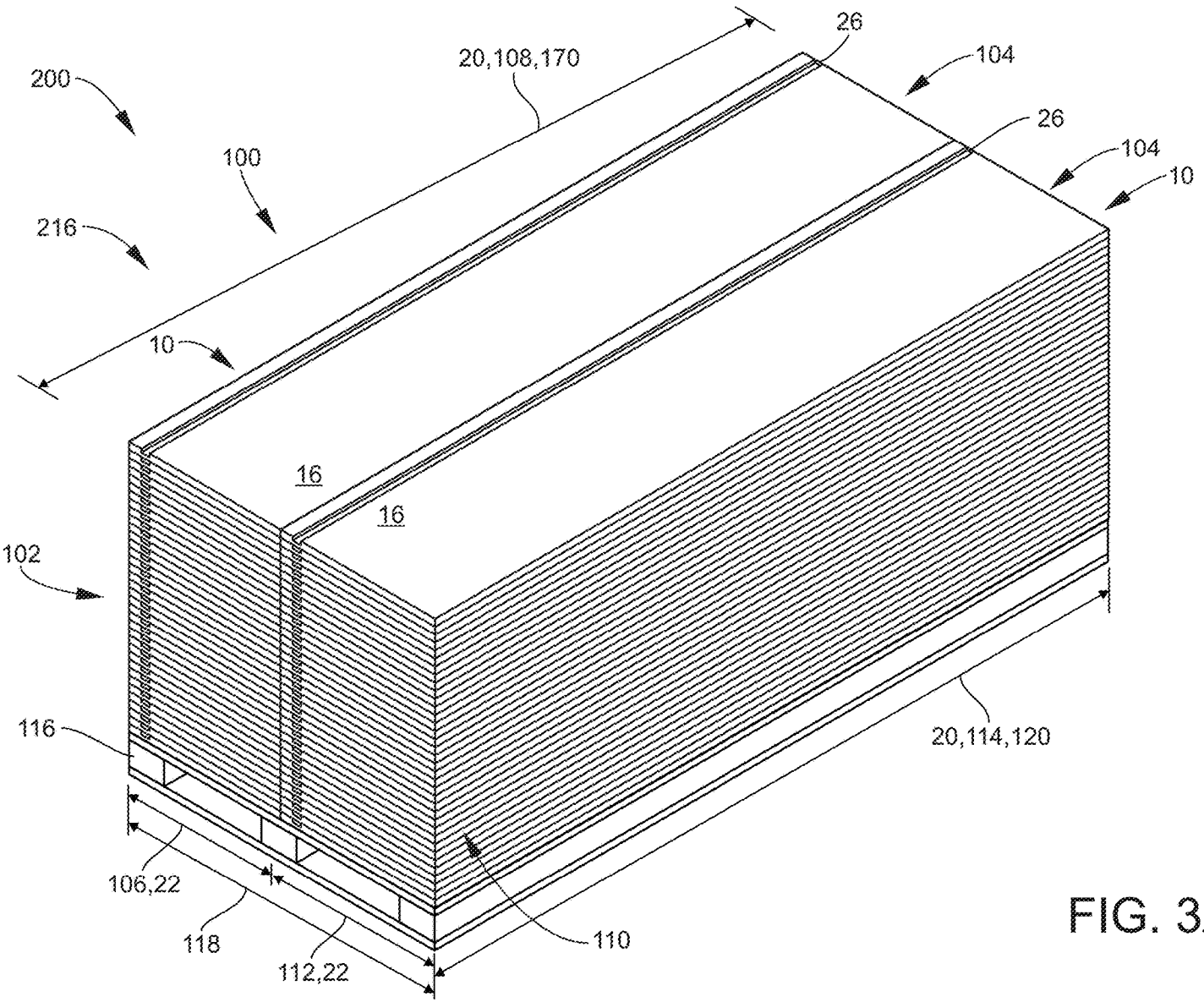
FIG. 3A schematically depicts a top perspective view of a pallet of wood blocking according to select embodiments of the instant disclosure.
Figure 3B:
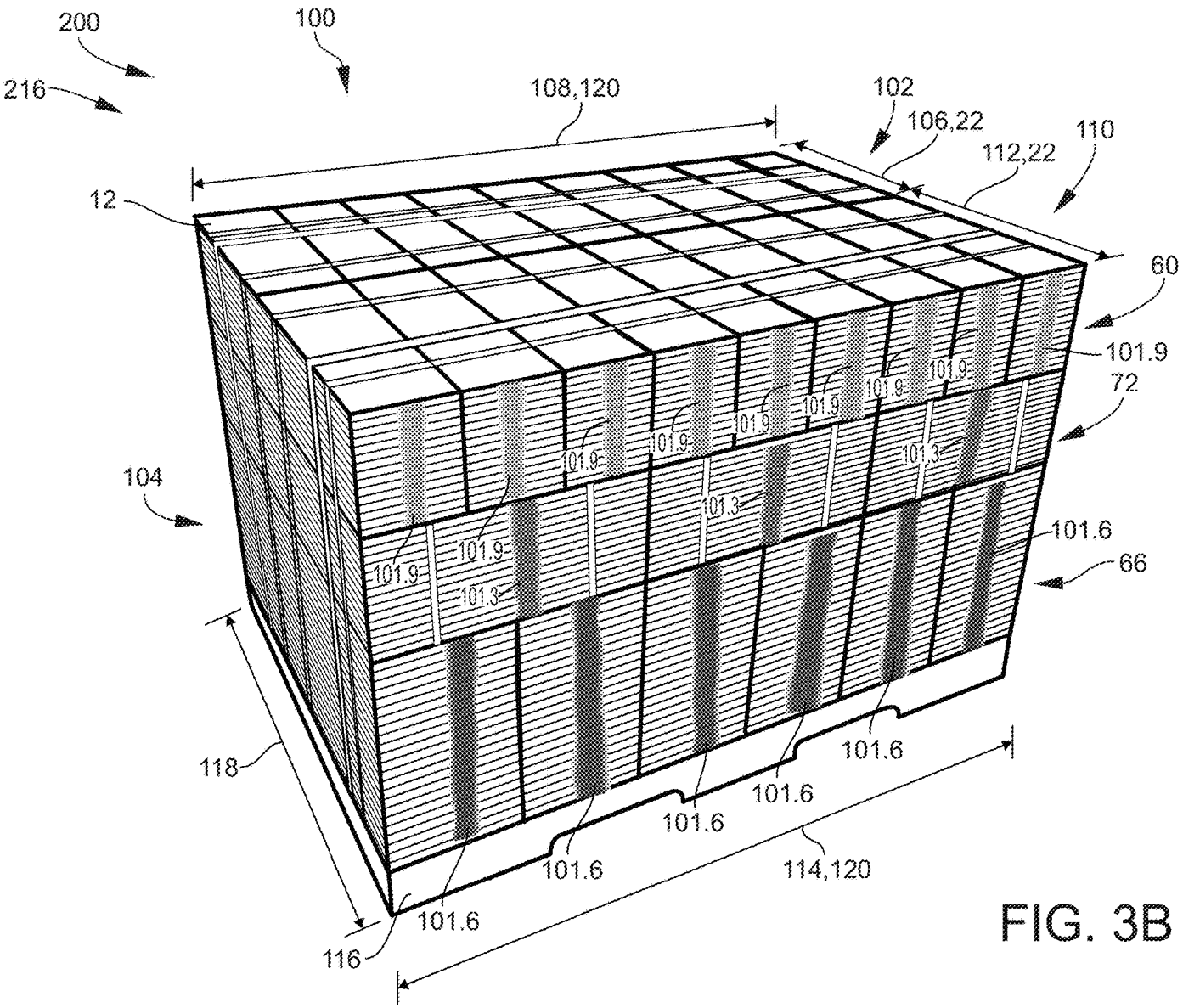
FIG. 3B schematically depicts a top perspective view of another pallet of wood blocking according to select embodiments of the instant disclosure.
Figure 4:
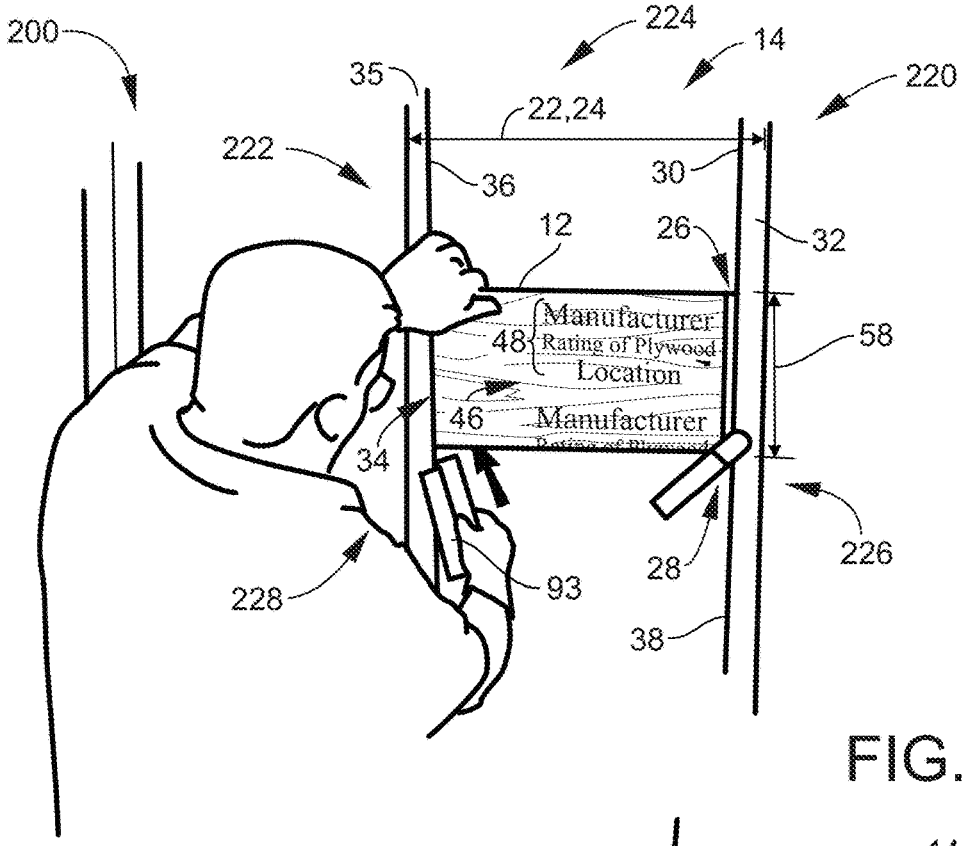
FIG. 4 shows an environmental front view of a wood blocking according to the instant disclosure being positioned for installation between two metal studs.
Figure 5:
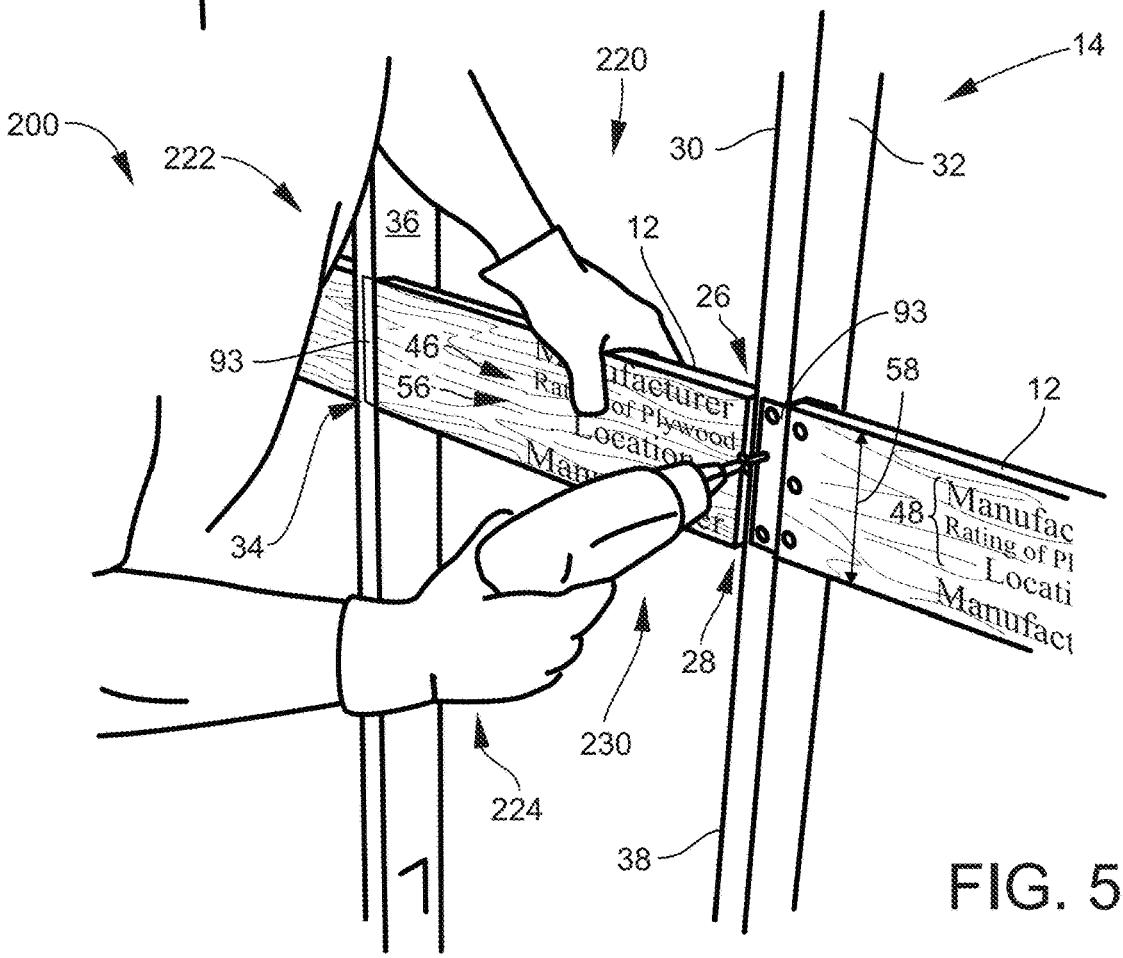
FIG. 5 shows an environmental perspective view of wood blocking according to select embodiments of the instant disclosure being installed between metal studs.
Figure 6:
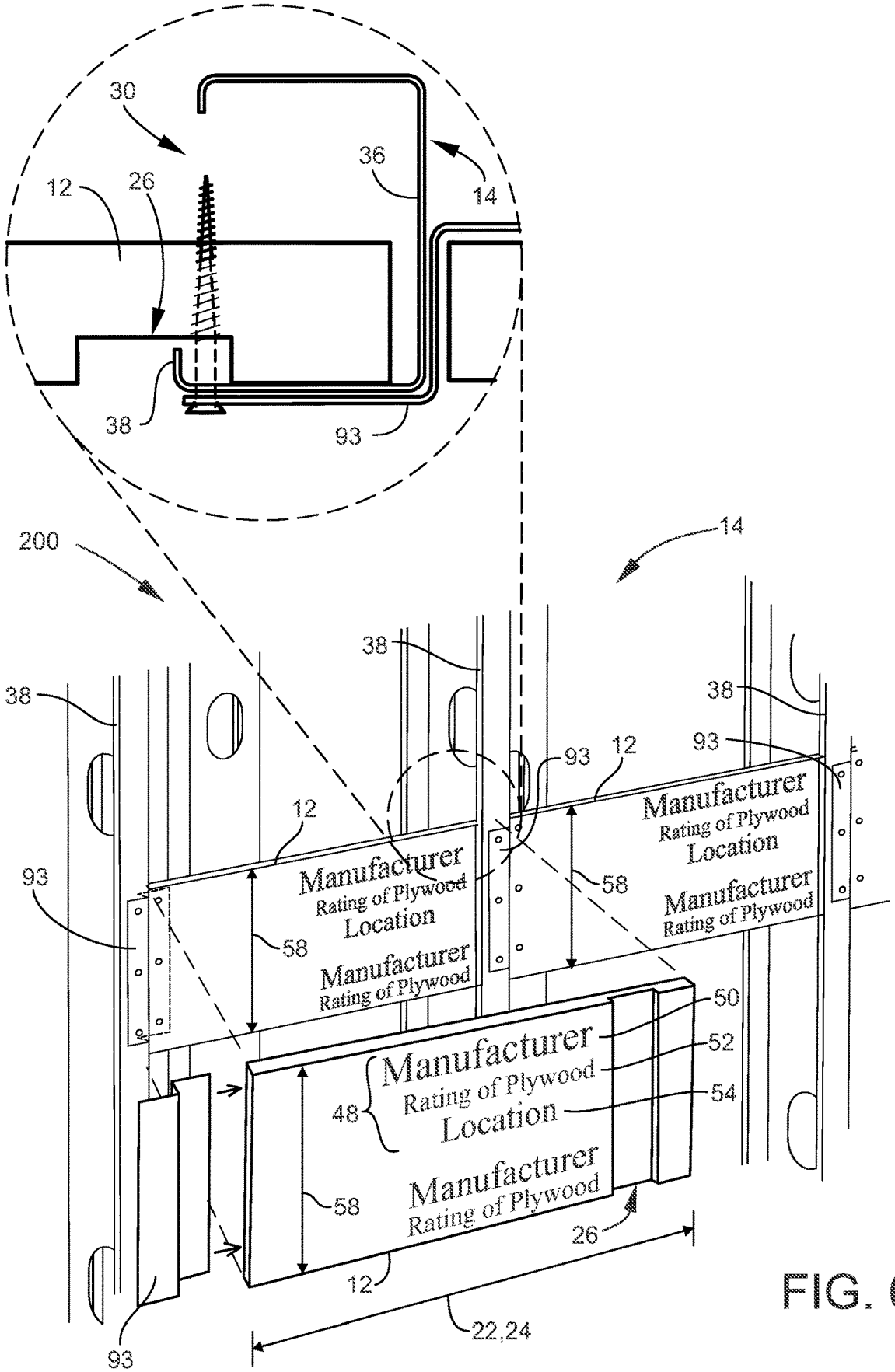
FIG. 6 shows an environmental perspective view of wood blocking according to select embodiments of the instant disclosure being installed between metal studs with z-clips.
Figure 7:
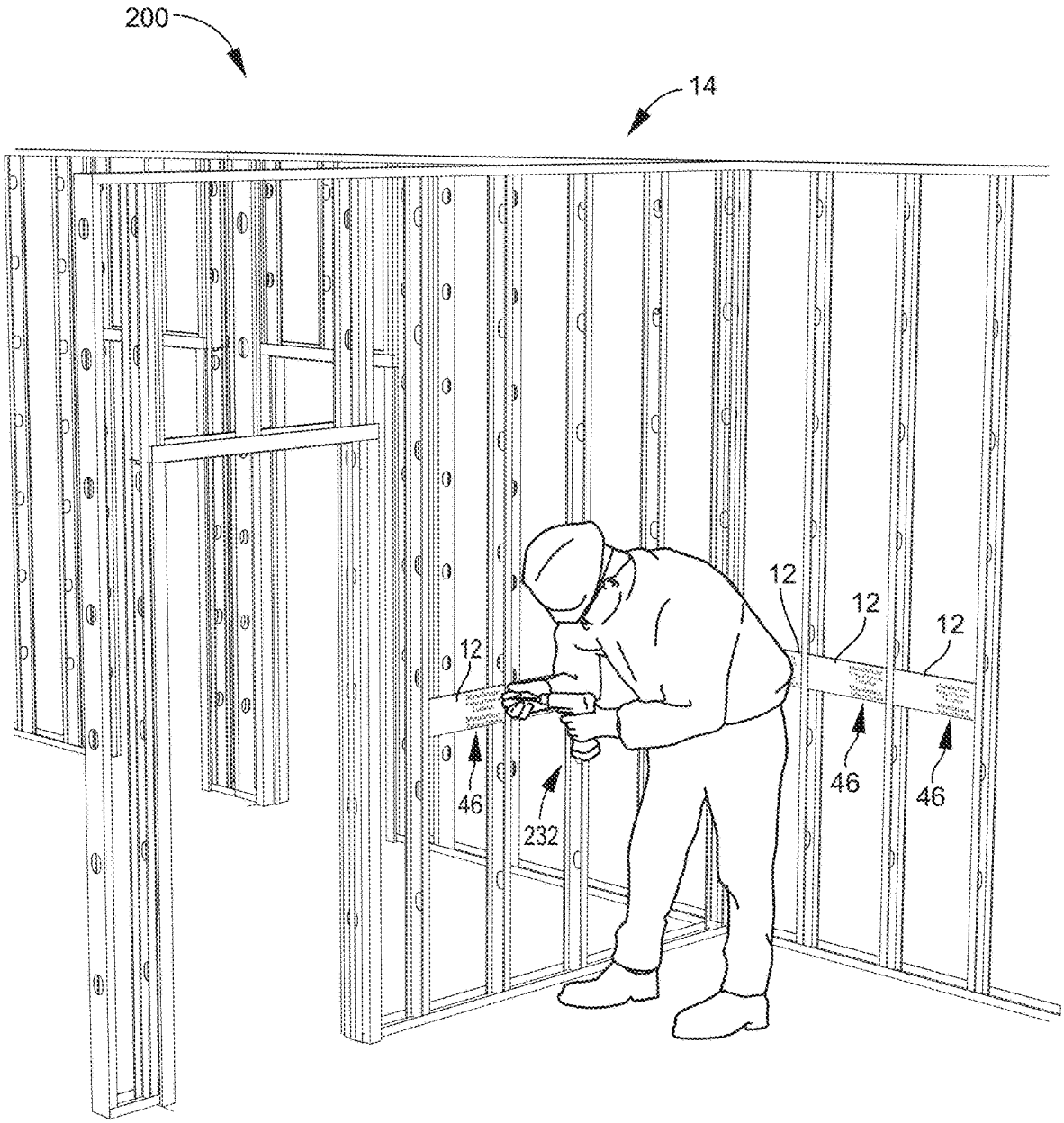
FIG. 7 shows an environmental perspective view of wood blocking according to select embodiments of the instant disclosure being installed between metal studs.
Figure 8:
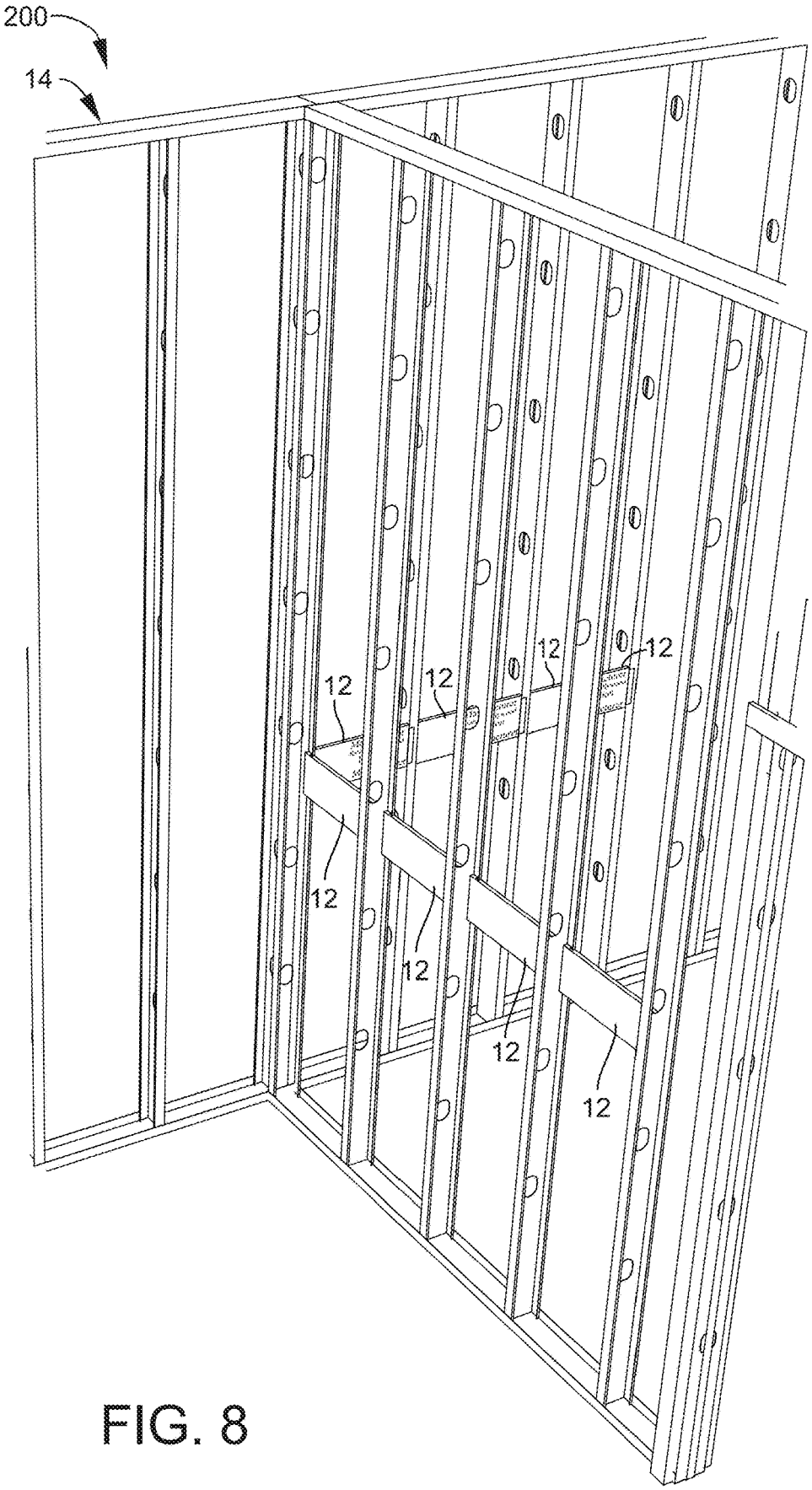
FIG. 8 shows an environmental perspective view of wood blocking according to select embodiments of the instant disclosure installed between metal studs.
Figure 9:
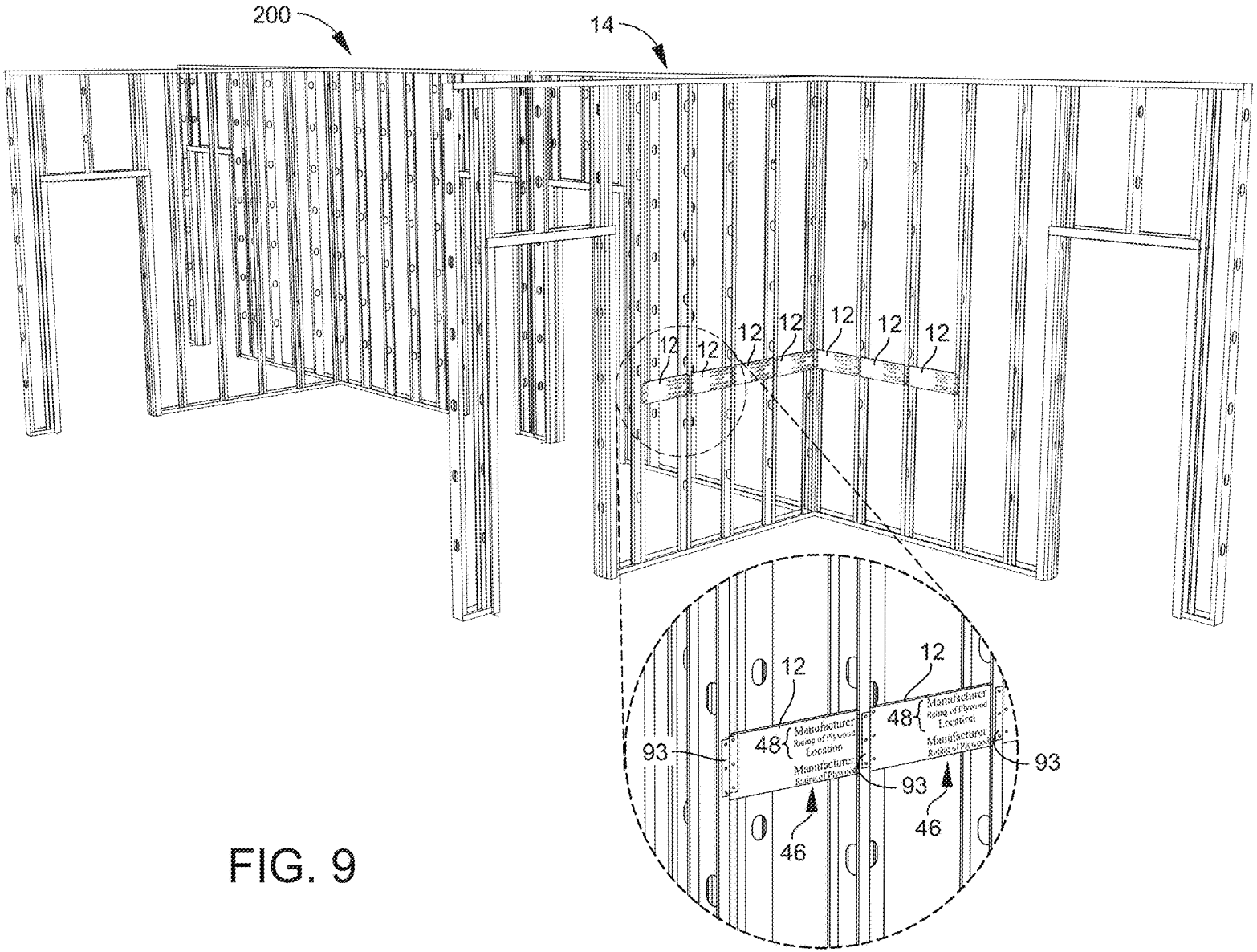
FIG. 9 shows an environmental perspective view of wood blocking according to select embodiments of the instant disclosure installed between metal studs with a zoomed in view showing the continuous stamp on the blockings and the z-clips used for installation.
Figure 10:
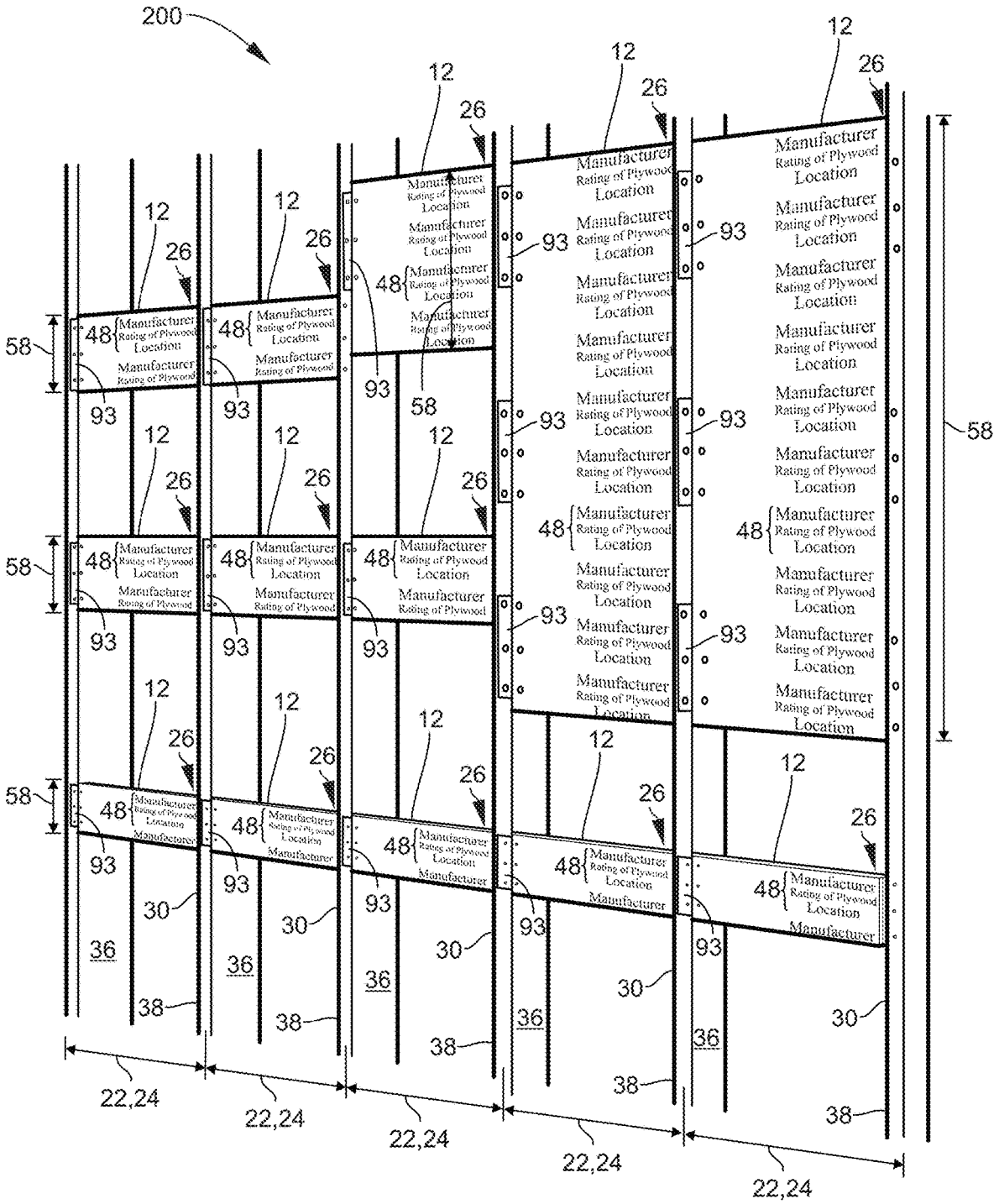
FIG. 10 shows another environmental perspective view of wood blocking according to select embodiments of the instant disclosure installed between metal studs in various sizes.

Referring now to FIGS. 3A and 3B, pallet 100 of wood blocking 12 is shown. Pallet 100 of wood blocking 12 may be created from multiple wood blocking blanks 10 or wood blockings 12 cut therefrom. Pallet 100 of wood blocking 12 may generally include first row 102 of wood blocking bundles 104 (see FIG. 1), second row 110 of wood blocking bundles 104, and base pallet 116. First row 102 of wood blocking bundles 104 on the pallet 100 may have first row width 106 and first row length 108. Likewise, second row 110 of wood blocking bundles 104 on the pallet 100 may have second row width 112 and second row length 114. As such, the base pallet 116 may have pallet width 118 of approximately the first row width 106 plus the second row width 112. The base pallet 116 may also have pallet length 120 of approximately the first row length 108 and/or the second row length 114. Whereby, the base pallet 116 may be configured for supporting the first and second rows 102, 110 of wood blocking bundles 104 side by side.

One feature of the pallet 100 of wood blocking 12 described herein may be that the pallet width 118 may be small enough to allow the pallet 100 of wood blocking 12 to be pulled through a door. This may allow for easy transportation and/or storage of pallet 100 and wood blocking 12 from various locations and jobsites. As an example, when the first row 102 of wood blocking 12 may have first row width 106 of approximately 15.75 inches and the second row 110 of wood blocking may have second row width 112 of approximately 15.75 inches, the pallet width 118 may be approximately 32 inches or less. As such, the pallet width 118 of approximately 32 inches or less may be small enough to allow the pallet 100 of wood blocking 12 to be pulled through a standard 3/0 door (approximately 34.5 inches). In select embodiments of the pallet 100 of wood blocking 12 disclosed herein, the first row 102 of wood blocking bundles 104 may have the first row length 108 being equal to original length 20 of panel 16 of blocking material 18 and first row width 106 of standard width 22 of the panel 16 of blocking material 18, and the second row 110 of wood blocking bundles 104 may have the second row length 114 being equal to the original length 20 of the panel 16 of blocking material 18 and the second row width 112 of the standard width 22 of the panel 16 of blocking material 18. Wherein, the base pallet 116 may have pallet width 118 of twice the standard width 22 of the panel 16 of blocking material 18, and pallet length 120 of the original length 20 of the panel 16 of blocking material 18. Whereby, the base pallet 116 may be configured for supporting the first and second rows 102, 110 of wood blocking bundles 104 side by side.

In select embodiments of the pallet 100 of wood blocking 12 disclosed herein, the first row 102 of wood blocking bundles 104 and the second row 110 of wood blocking bundles 104 may include, but are not limited to: a single blank 10 of the original length 20 of the panel 16 of blocking material 18 (as shown in FIG. 3A); two bundles 104 of the original length 20 of the panel 16 of blocking material 18 cut in halves 74; three bundles 104 of the original length 20 of the panel 16 of blocking material 18 cut in thirds 72 (middle layer of pallet 100 in FIG. 3B); four bundles 104 of the original length 20 of the panel 16 of blocking material 18 cut in fourths 70; five bundles 104 of the original length 20 of the panel 16 of blocking material 18 cut in fifths 68; six bundles of the original length 20 of the panel 16 of blocking material 18 cut in sixths 66 (bottom layer of pallet 100 in FIG. 3B); seven bundles 104 of the original length 20 of the panel 16 of blocking material 18 cut in sevenths 64; eight bundles 104 of the original length 20 of the panel 16 of blocking material 18 cut in eighths 62; nine bundles 104 of the original length 20 of the panel 16 of blocking material 18 cut in ninths 60 (top layer of pallet 100 in FIG. 3B); or combinations thereof that equal the original length 20 of the panel 16 of blocking material 18 (as shown in FIG. 3B).

Referring now specifically to the embodiment of pallet 100 shown in FIG. 3A, first row 102 and second row 110 are each made of a single blank 10 of blanks 10. Each bundle 104 of blanks 10 has 36 blanks 10 for a total of 72 blanks 10 on each pallet 100.

Referring now specifically to the embodiment of pallet 100 shown in FIG. 3B, first row 102 and second row 110 are each made of multiple various bundles 104 of wood blocking 12 created from blanks 10. As shown, the bottom layer includes 6 bundles 104 of the original length 20 of the panel 16 of blocking material 18 cut in sixths 66, the middle layer includes 3 bundles 104 of the original length 20 of the panel 16 of blocking material 18 cut in thirds 72, and the top layer includes 9 bundles 104 of the original length 20 of the panel 16 of blocking material 18 cut in ninths 60. As should be clearly understood, the disclosure is not so limited to the embodiments shown in FIGS. 3A and 3B of pallet 100, and other various combinations of bundles 104 may be created. In select embodiments, pallet 100 may be manufacture with 72 blanks 10. When cut up, we have 72 bundles 104. 1 blank 10 may be equal to 1 bundle 104. The pallet 100 shown in FIG. 3B represents a mixed pallet in which there are 72 bundles of different sizes. Bundles 104 may include color coding 101 (like red, blue, green, yellow, orange, purple, etc.), where a different color is used for each size of blocking 12 in bundles 104. This may include, but is not limited to, 101.9, as shown in FIG. 1 and the top layer in FIG. 3B for bundles 104 of the original length 20 of the panel 16 of blocking material 18 cut in ninth 60, 101.6, as shown in the bottom layer of FIG. 3B for bundles 104 the original length 20 of the panel 16 of blocking material 18 cut in sixths 66, and 101.3, as shown in the middle layer of FIG. 3B of bundles 104 of the original length 20 of the panel 16 of blocking material 18 cut in thirds 72. This color coding 101 may be for supplier/installer to recognize the size difference, as a bundle of wood may look the same if this is not done.

A weight of each bundle 104 may be equal to a nominal weight of the panel of blocking material. As a result, a total weight of the first row 102 of wood blocking 12 and a total weight of the second row 110 of wood blocking 12 may be approximately equal to a row of the panel 16 of blocking material 18. In addition, an area or square footage of each bundle 104 may be equal to a nominal area or square footage of the panel 16 of blocking material 18. As a result, a total volume or cubic footage of the first row 102 of wood blocking 12 and a total volume or cubic footage of the second row 110 of wood blocking may be approximately equal to a row of the panel 16 of blocking material 18. As such, each pallet 100, row 102 and 110, purchased or required may be easily used for a commercial estimate for calculating labor and material.

Referring now to FIGS. 1-11, method 200 of installing wood blocking 12 between metal studs 14 is disclosed herein. Method 200 of installing wood blocking 12 may generally include step 202 of creating wood blocking blank 10 for creating wood blocking 12 for placement between metal studs 14, in any of the various embodiments shown and/or described herein of wood blocking blank 10. See FIGS. 1-2. As a result, the method 200 may include the step 204 of cutting groove 26 down the entire original length 20 of the panel 16 of blocking material 18 approximate first side 28 of panel 16 of blocking material 18. See FIGS. 1-2. The groove 26 may be configured for orienting the first side 28 of panel 16 of blocking material 18, and any wood blocking 12 created or cut therefrom, in soft side 30 of first metal stud 32 and second side 34 of the panel 16 of blocking material 18, and any wood blocking 123 created or cut therefrom, against the hard side 36 of an adjacent metal stud 25. Groove 26 cut in step 204 may be sized to receive lip 38 of the soft side of the metal stud. In addition, method 200 of installing wood blocking 12 between metal studs 14 may include step 206 of cutting the original length 20 of the panel 16 of blocking material 18 to a desired height 58 of wood blocking 12 or leaving the original length 20 of the panel 16 of blocking material 18 at the original length 20 for the desired height 58 of the wood blocking 12.

Step 204 of cutting groove 26 down the entire original length 20 of the panel 16 of blocking material 18 may include step 208 of cutting through dado 40 running the entire original length 20 of the panel 16 of blocking material 18 across grain from top edge 42 to bottom edge 44. The through dado cut in step 208 may be, but is not limited to, approximately 0.3 inches deep by 0.75 inches wide along the entire original length 20 of the panel 16 of blocking material 18. In select embodiments, the center of the groove 26 may be cut a distance from the first side 28 of the panel 16 of blocking material 18 that is approximately a width of the stud flange. As examples, the center of the groove 26 may be cut approximately 1.25", 1.375", 1.625", 2.0", 2.5", 3.0", etc. from the first side 28 of the panel 16, to fit stud flanges with widths of 1.25", 1.375", 1.625", 2.0", 2.5", 3.0", etc. However, the width of the groove may be cut wide enough to receive the lip from multiple size widths of stud flanges. As such, as a first example, when the center of the groove 26 may be cut approximately 1.375" from the first side 28 of the panel 16, the groove may be wide enough to fit stud flanges with widths of 1.25", 1.375", and 1.625". As another example, when the center of the groove 26 may be cut approximately 2.5" from the first side 28 of the panel 16, the groove may be wide enough to fit stud flanges with widths of 2.0", 2.5", and 3.0".

Step 210 of applying continuous stamp 46 along the entire original length 20 of the panel 16 of blocking material 18 may be included in method 200 of installing wood blocking 12 between metal studs 14. The continuous stamp 46 applied in step 210 may be applied with repeated information 48 of the blocking material 18 that is configured to be visible on each piece of blocking 12 created from the panel 16 of blocking material 18. The repeated information 48 of the continuous stamp 46 applied along the entire original length 20 of the blocking material 18 may include, but is not limited to, manufacturer 50, rating of blocking material 52, and location 54, wherein each piece of blocking 12 created from the panel 16 of blocking material 18 may include at least the manufacturer 50, the rating of blocking material 52, and the location 54. The continuous stamp 46 applied in step 210 may be positioned approximate the second side 34 of the panel 16 of blocking material 18 in horizontal orientation 56, whereby the continuous stamp 46 may be configured to be visible when installed between the metal studs 14.

Step 206 of cutting the length 20 of the panel 16 of blocking material 18 to desired height 58 of wood blocking 12 or leaving the length 20 of the panel 16 of blocking material 18 at the original length 20 for the height 58 of the wood blocking 12 may include step 212 of cutting the original length 20 in ninths 60, eighths 62, sevenths 64, sixths 66, fifths 68, fourths 70, thirds 72, halves 74, combinations thereof, or left at the original length 20. See FIGS. 1-2.

Step 214 of bundling the wood blocking 12 into bundles 104 of the wood blocking 12 may be included in method 200 of installing wood blocking 12 between metal studs 14. See FIGS. 1-2.

Step 216 of creating pallet 100 of the wood blocking 12 from the bundles 104 for transportation may be included in select embodiments of method 200 of installing wood blocking 12 between metal studs 14. See FIG. 3.

Referring now to FIG. 11, in select embodiments of the method 200 of installing wood blocking 12 disclosed herein, the method 200 may further include step 218 of putting the wood blocking 12, the bundles 104, the pallet 100 of wood blocking 12, or combinations thereof into a commercial estimate for calculating labor and material.

Referring now to FIGS. 4-10, step 219 of mounting the wood blocking 12 between metal studs 14 may be included in select embodiments of method 200 of installing wood blocking 12 between metal studs 14. This step 219 of mounting the wood blocking 12 between metal studs 14 may include any methods, tools, devices, etc. for mounting wood blocking 12 between metal studs 14. In select embodiments, as shown in the figures, step 219 of mounting the wood blocking 12 between metal studs 14 may include: step 220 of orienting the groove 26 on the first side 28 of the blocking 12 in soft side 30 of first metal stud 32, where lip 38 of the soft side 30 of the metal stud 32 is positioned in the groove 26 (see FIG. 4); step 222 of orienting second side 34 of the blocking 12 against the hard side 36 of adjacent metal stud 35 (see FIG. 4); and step 224 of securing the wood blocking 12 between the metal studs 14 (see FIGS. 5-7). In select embodiments, the step 224 of securing the wood blocking 12 between the metal studs 14 may include: step 226 of clamping the first side 28 of the wood blocking 12 to the soft side 30 of the first metal stud 32 (see FIG. 4); step 228 of clamping the second side 34 of the wood blocking 12 to the hard side 36 of the adjacent metal stud 35 (see FIG. 4); step 230 of attaching the first side 28 of the wood blocking 12 to the soft side 30 of the first metal stud 32 with fasteners, like screws (see FIG. 5); and step 232 of attaching the second side 34 of the wood blocking 12 to the hard side 36 of the adjacent metal stud 35 with fasteners, like screws) and z-clip 93 (see FIGS. 5, 6, 9 and 10). Z-clip 93 may be installed by positioning the z-clip 93 between the second side 34 of the wood blocking 12 and the hard side 36 of the adjacent metal stud 35, and then using fasteners to fasten one side of the z-clip 93 to the second side 34 of the wood blocking 12 and the other side of the z-clip 93 to the adjacent metal stud 35. Best shown in FIG. 6.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

The invention claimed is:

1. A wood blocking system including wood blocking placed between metal studs, the wood blocking system comprising:

a panel of a blocking material having a length of 48 inches and a standard width;

the standard width of the panel of the blocking material is sized to a nominal stud width configured to fit between the metal studs;

the metal studs including a first metal stud and an adjacent metal stud;

each of the first metal stud and the adjacent metal stud are c-channel metal studs including:

a hard side including a flat web; and a soft side with an inner flange having an inner return lip and an outer flange having an outer return lip;

where the c-channel is created from the flat web of the hard side and the soft side with the inner flange having the inner return lip and the outer flange having the outer return lip;

a groove cut down the entire length of the panel approximate a first side of the panel, said groove is configured to receive the outer return lip of the soft side of the metal stud, whereby the groove is configured to orient the first side of the panel in the soft side of the first metal stud and a second side of the panel against the hard side of the adjacent metal stud;

wherein the groove is a through dado running the entire length of the panel across grain from a top edge to a bottom edge, wherein the through dado is approximately 0.3 inches deep by 0.75 inches wide along the entire length of the panel configured to receive multiple size widths of stud flanges, wherein the through dado is configured to receive the outer return lip of the outer flange of the first metal stud;

wherein the length of the panel being configured to be cut to a desired height of blocking or left at the length, wherein the length of the panel being configured to be cut in ninths, eighths, sevenths, sixths, fifths, fourths, thirds, halves, combinations thereof, or left at the length, wherein the cut lengths are:

approximately 5 and ⅛ inches when cut in ninths;
approximately 5 and ⅞ inches when cut in eighths;
approximately 6 and ¾ inches when cut in sevenths;
approximately 7 and ⅞ inches when cut in sixths;
approximately 9 and ½ inches when cut in fifths;
approximately 11 and ¾ inches when cut in fourths;
approximately 15 and ¾ inches when cut in thirds;
approximately 23 and ⅞ inches when cut in halves; and
approximately 48 inches when left at the original length; and a continuous stamp along the entire length of the panel, said continuous stamp including repeated information of the blocking material that is configured to be visible on each piece of blocking created from the panel, wherein the repeated information of the continuous stamp along the entire length of the blocking material including a manufacturer, a rating of blocking material, and a location, wherein each piece of blocking created from the panel includes at least the manufacturer, the rating of blocking material, and the location, wherein the continuous stamp being positioned approximate the groove of the panel in a horizontal orientation, whereby the continuous stamp is configured to be visible when installed between the metal studs for inspection.

2. The wood blocking system according to claim 1, wherein:

the center of the groove is cut approximately 1.375" from the first side of the panel, whereby the groove is wide enough to fit stud flanges with widths of 1.25", 1.375", and 1.625"; or the center of the groove is cut approximately 2.5" from the first side of the panel, whereby the groove is wide enough to fit stud flanges with widths of 2.0", 2.5", and 3.0".

3. The wood blocking system according to claim 1, wherein the original length is 48 inches and the standard width is 15.75 inches being sized to the nominal stud width between the metal studs of 16 inches, wherein the blockings are:

a number five blocking of approximately 5 and ⅛ inches by 15.75 inches when cut in ninths;

a number six blocking of approximately 5 and ⅞ inches by 15.75 inches when cut in eighths;

a number seven blocking of approximately 6 and ¾ inches by 15.75 inches when cut in sevenths;

a number eight blocking of approximately 7 and ⅞ inches by 15.75 inches when cut in sixths;

a number ten blocking of approximately 9 and ½ inches by 15.75 inches when cut in fifths;

a number twelve blocking of approximately 11 and ¾ inches by 15.75 inches when cut in fourths;

a number sixteen blocking of approximately 15 and ¾ inches by 15.75 inches when cut in thirds;

a number twenty-four blocking of approximately 23 and ⅞ inches by 15.75 inches when cut in halves; and a number forty-eight blocking of approximately 48 inches by 15.75 inches when left at the original length.

4. The wood blocking system according to claim 1, wherein the original length is 48 inches and the standard width is 11.75 inches, 13.25 inches, 15.75 inches, 19.05 inches, or 23.75 inches being sized to the nominal stud width between the metal studs of 12 inches, 13.5 inches, 16 inches, 19.2 inches or 24 inches, respectively, wherein the blockings are:

approximately 5 and ⅛ inches by 11.75 inches, 13.25 inches, 15.75 inches, 19.05 inches, or 23.75 inches, when cut in ninths;

approximately 5 and ⅞ inches by 11.75 inches, 13.25 inches, 15.75 inches, 19.05 inches, or 23.75 inches, when cut in eighths;

approximately 6 and ¾ inches by 11.75 inches, 13.25 inches, 15.75 inches, 19.05 inches, or 23.75 inches, when cut in sevenths;

approximately 7 and ⅞ inches by 11.75 inches, 13.25 inches, 15.75 inches, 19.05 inches, or 23.75 inches, when cut in sixths;

approximately 9 and ½ inches by 11.75 inches, 13.25 inches, 15.75 inches, 19.05 inches, or 23.75 inches, when cut in fifths;

approximately 11 and ¾ inches by 11.75 inches, 13.25 inches, 15.75 inches, 19.05 inches, or 23.75 inches, when cut in fourths;

approximately 15 and ¾ inches by 11.75 inches, 13.25 inches, 15.75 inches, 19.05 inches, or 23.75 inches, when cut in thirds;

approximately 23 and ⅞ inches by 11.75 inches, 13.25 inches, 15.75 inches, 19.05 inches, or 23.75 inches, when cut in halves; and approximately 48 inches by 11.75 inches, 13.25 inches, 15.75 inches, 19.05 inches, or 23.75 inches, when left at the original length.

* * * * *